US006699096B2

(12) United States Patent
Christopherson et al.

(10) Patent No.: US 6,699,096 B2
(45) Date of Patent: Mar. 2, 2004

(54) TOY WITH CHARACTER AND VEHICLE COMPONENTS

(75) Inventors: Karl A. Christopherson, Warwick, RI (US); Paul T. Franer, Cincinnati, OH (US); Gregory L. Gerold, Cincinnati, OH (US); Joseph J. Khan, New Richmond, OH (US)

(73) Assignee: Hasbro, Inc., Pawtucket, RI (US)

( * ) Notice: Subject to any disclaimer, the term of this patent is extended or adjusted under 35 U.S.C. 154(b) by 7 days.

(21) Appl. No.: 09/880,020

(22) Filed: Jun. 14, 2001

(65) Prior Publication Data

US 2002/0061706 A1 May 23, 2002

Related U.S. Application Data

(60) Provisional application No. 60/211,494, filed on Jun. 14, 2000.

(51) Int. Cl.[7] ..... A63H 17/25

(52) U.S. Cl. ..... 446/275; 446/298; 446/330; 446/354

(58) Field of Search ..... 446/268, 269, 446/270, 272, 274, 280, 281, 288, 144, 93–96, 431, 434, 457, 460, 465, 470, 157, 278, 279, 308, 309, 315, 332, 409, 410, 466

(56) References Cited

U.S. PATENT DOCUMENTS

| | | | | | |
|---|---|---|---|---|---|
| 2,296,541 | A | * | 9/1942 | Schuyler | 40/419 |
| 2,603,913 | A | * | 7/1952 | Ernst | 446/288 |
| 2,935,816 | A | * | 5/1960 | Michael | 446/272 |
| 4,184,286 | A | | 1/1980 | Spengler et al. | |
| 4,186,515 | A | * | 2/1980 | Ogawa | 446/123 |
| 4,236,344 | A | | 12/1980 | Kelly | |
| 4,239,217 | A | * | 12/1980 | Thieme et al. | 273/108.22 |
| 4,573,944 | A | | 3/1986 | Crow et al. | |
| 4,583,957 | A | | 4/1986 | Levy | |
| 4,623,320 | A | | 11/1986 | Kakizaki et al. | |
| 4,626,164 | A | | 12/1986 | Chang | |
| 4,673,367 | A | | 6/1987 | MacBain | |
| 4,708,687 | A | | 11/1987 | Goldberg et al. | |
| 4,954,117 | A | * | 9/1990 | Daleus et al. | 40/219 |
| 5,052,680 | A | * | 10/1991 | Malewicki et al. | 100/233 |
| 5,295,889 | A | | 3/1994 | Ejima | |
| 5,306,197 | A | | 4/1994 | Watanabe | |
| 5,310,379 | A | * | 5/1994 | Hippely et al. | 446/279 |
| 5,334,078 | A | | 8/1994 | Hippely et al. | |
| 5,525,090 | A | | 6/1996 | Halford et al. | |
| 5,584,743 | A | | 12/1996 | Beaulieu | |
| 5,964,640 | A | | 10/1999 | Barton et al. | |
| 6,039,626 | A | | 3/2000 | Gerold et al. | |

* cited by examiner

*Primary Examiner*—Derris H. Banks
*Assistant Examiner*—Bena B. Miller
(74) *Attorney, Agent, or Firm*—Fish & Richardson P.C.

(57) ABSTRACT

An action figure includes an upper body having robotic features and a lower body interconnected with the upper body. The upper body includes a head and arms connected to a torso that connects to the lower body. The lower body includes construction tools, a chassis and front and rear wheels attached to the chassis. The action figure has a sound generation system that generates a sound such as a whistle or a phrase by actuation of sound activating switches.

23 Claims, 9 Drawing Sheets

TOY WITH CHARACTER AND VEHICLE COMPONENTS

CROSS-REFERENCE TO RELATED APPLICATIONS

This application claims priority from U.S. Provisional Application No. 60/211,494 titled "TOY WITH CHARACTER AND VEHICLE COMPONENTS" and filed on Jun. 14, 2000, which is incorporated herein by reference.

TECHNICAL FIELD

This invention relates to toy action figures.

BACKGROUND

Action figures include toys with robotic, human or animal characteristics. Action figures may have legs or wheels for mobility and may hurl or grasp objects with their arms. Some action figures generate sounds. Action figures also may be convertible from a character into a vehicle such as a truck, an airplane, or a rocket.

SUMMARY

In one general aspect, an action figure includes an upper body having robotic features and a lower body interconnected with the upper body. The upper body includes a head and arms connected to a torso that connects to the lower body. The lower body includes construction tools, a chassis, and front and rear wheels attached to the chassis.

Implementations may include one or more of the following features. For example, the wheels may be encircled by treads. One of the arms may include a fist capable of being propelled. The fist may be positioned parallel to the ground and may be capable of being rotated relative to an axis that is perpendicular to the torso. The second arm may include a release mechanism enabling propulsion of the fist. One arm may include characteristics of a shovel. Similarly, the upper body may include other characteristics of construction equipment, such as an arm that includes features of a backhoe. The upper body may be capable of being rotated relative to the lower body.

The construction tools on the lower body may include earth moving equipment such as a loader bucket attached to the chassis by support members. The support members may have characteristics of robotic legs. The lower body may have a hinge connecting a support member to the loader bucket and enabling movement of the loader bucket relative to the chassis. The lower body may also have a lever for moving the loader bucket. One of the arms may also include a telescoping support member for movement of the loader bucket.

The action figure may have a sound generation system that generates a sound such as a whistle or a phrase by actuation of sound activating switches. For example, movement of a loader bucket attached to the chassis by a support member may generate a sound by actuating a sound activating switch. Movement of the arms may generate a sound by actuating a sound-activating switch. The torso may include a button, and a sound may be generated by the sound generation system upon pressing the button.

The action figure has the advantages of a toy that includes an upper body with robotic features and a lower body with a chassis and front and rear wheels. The action figure generates sounds and phrases to engage a person in playing with the toy.

Other features and advantages will be apparent from the description and drawings, and from the claims.

DESCRIPTION OF DRAWINGS

Like reference symbols in the various drawings indicate like elements.

DETAILED DESCRIPTION

Figure 1A:
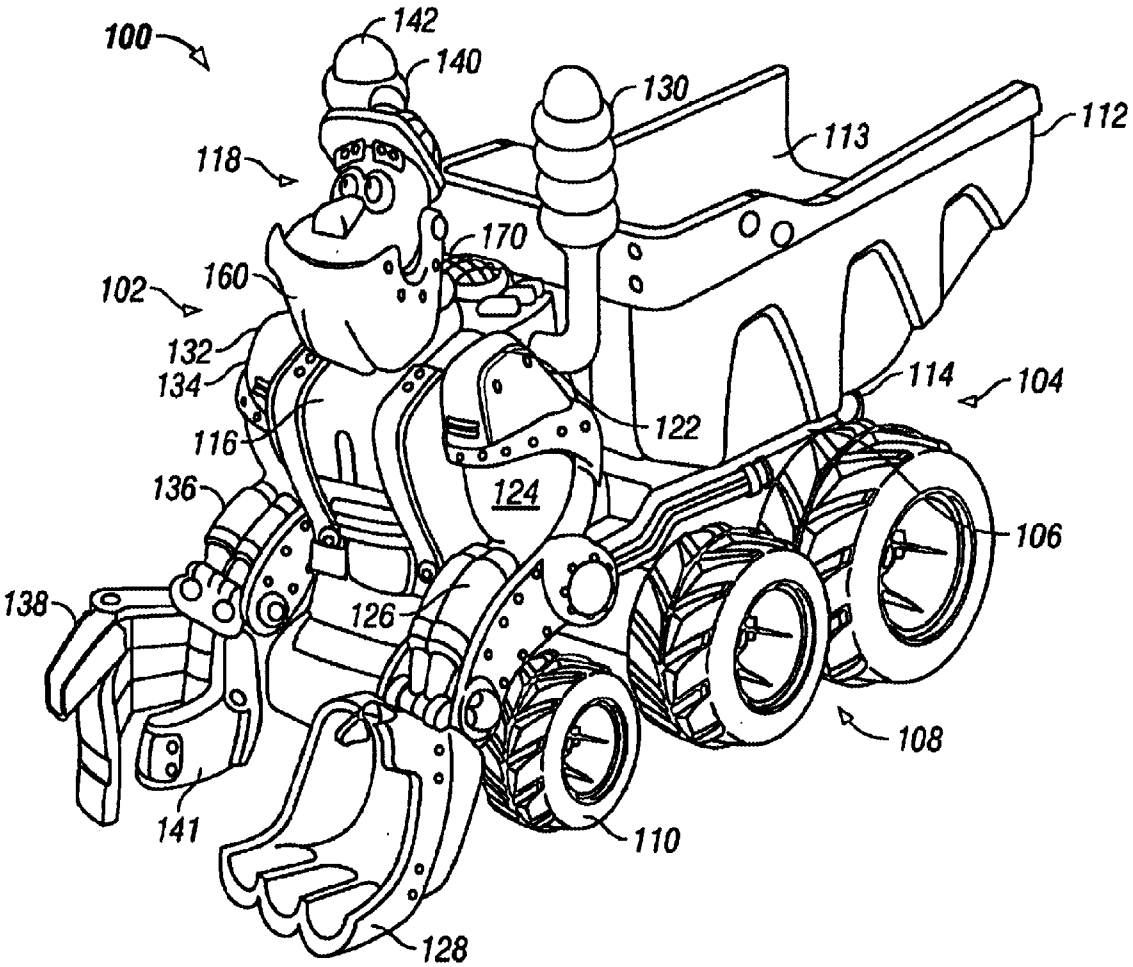
FIGS. 1A and 1B are perspective and top views of a toy.
Figure 1B:
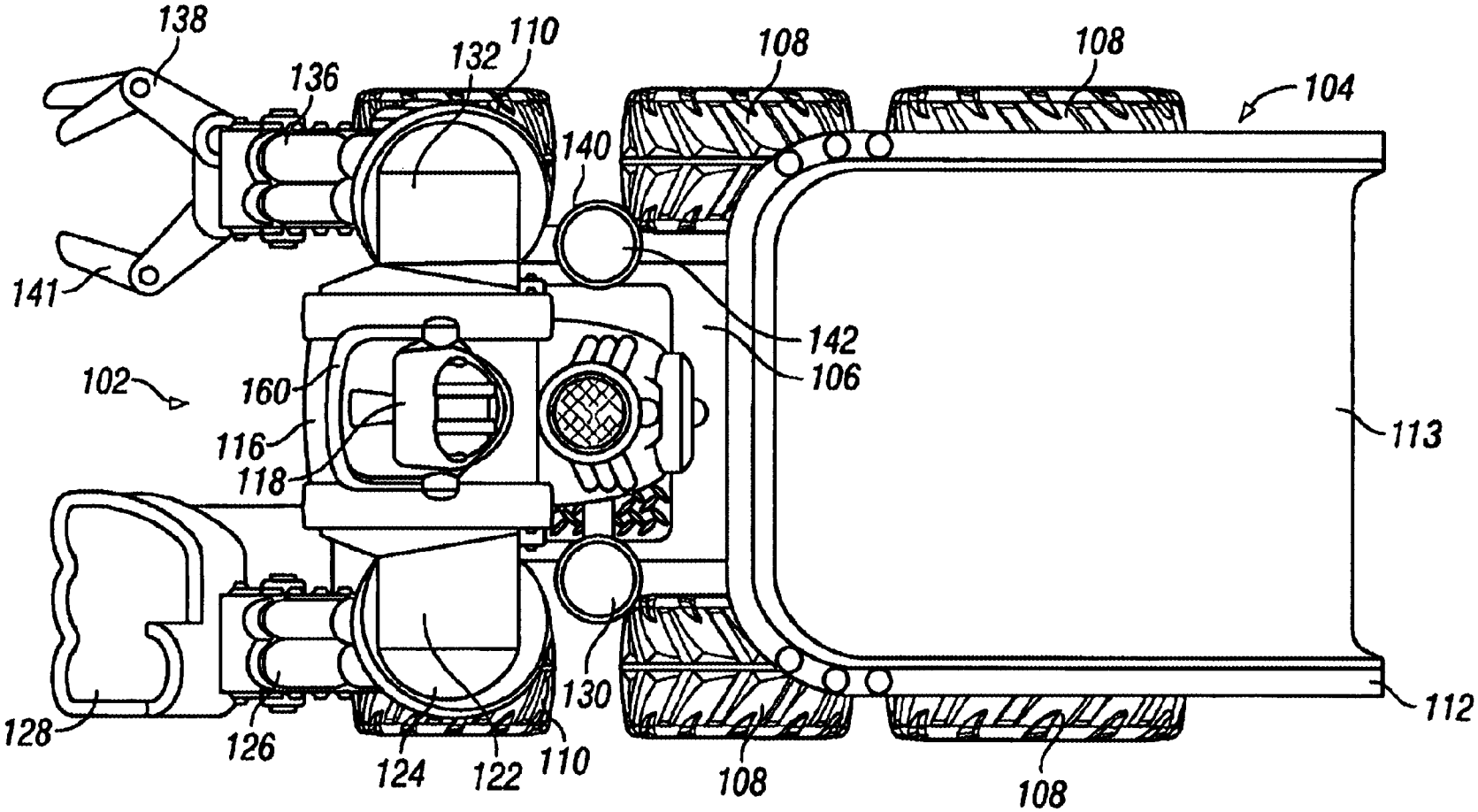

Referring to FIGS. 1A and 1B, a toy 100 includes a front body section 102 having character features and a rear body section 104 having vehicular features and connected to the front body section 102. The rear body section 104 includes a chassis 106. A pair of freely rotatable rear wheels 108 are attached to the chassis 106 on each side of the toy 100, and a freely rotatable front wheel 110 is attached to the front body section 102. The pair of rear wheels 108 are positioned with a first of the rear wheels behind a second of the rear wheels, the first of the rear wheels having a larger diameter than the second of the rear wheels. The front wheel 110 has a smaller diameter than the rear wheels 108. The rear body section 104 also includes a bed 112 that defines a cavity 113 for holding objects. The bed 112 is hingedly connected to the chassis 106 so that the bed may be tilted to dump the objects collected in the bed.

The front body section 102 includes a torso 116 connected to the chassis 106 and a head 118 connected to the torso, such that the front body section has the features of a character. The torso 116 is rotatable relative to the chassis 106. Two arms 122, 132 are hingedly connected to the torso 116.

Figure 2:
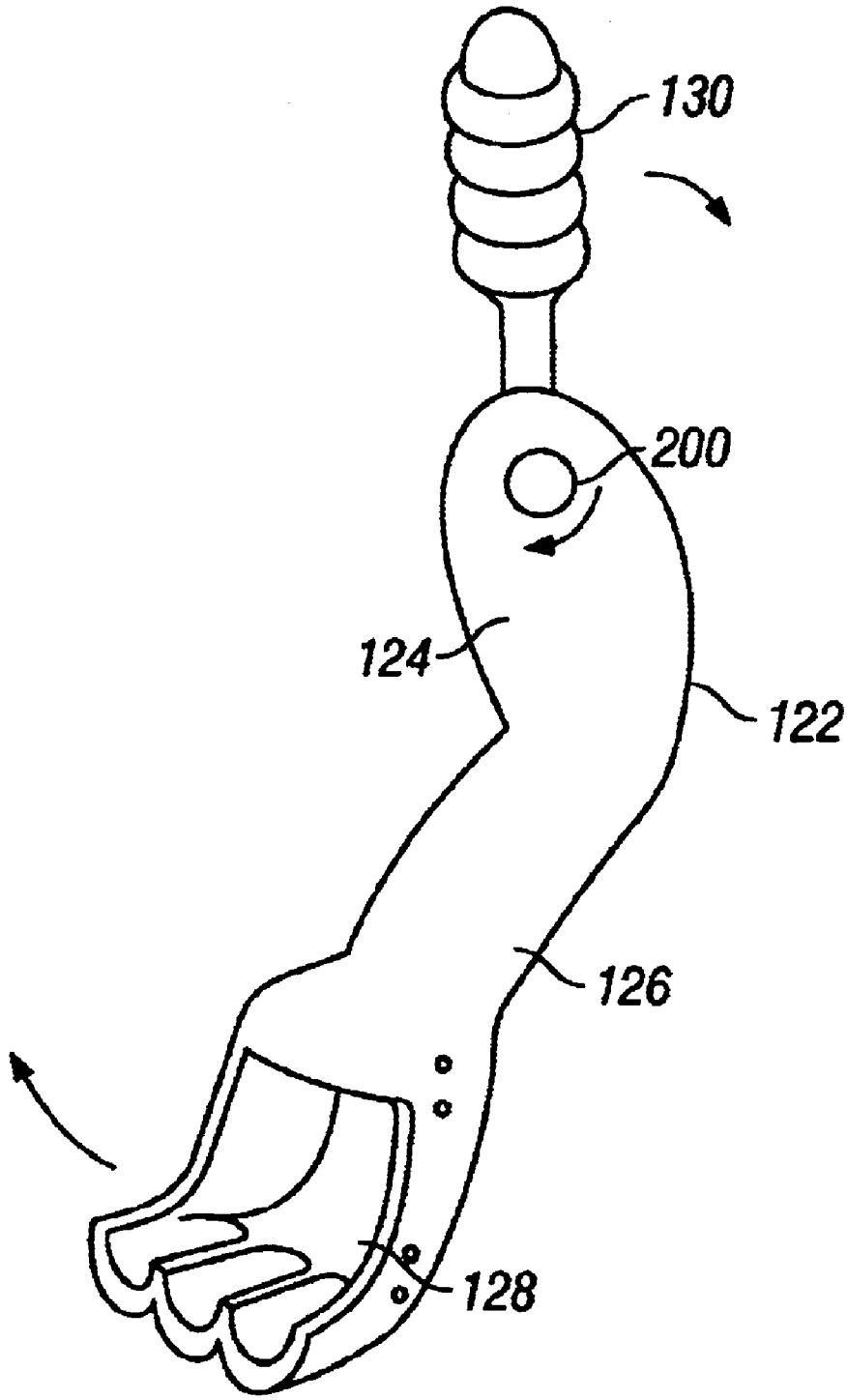
FIGS. 2, 3A, and 3B are front and side schematic views of handle and arm components of the toy of FIGS. 1A–B.

Referring to FIG. 2, the left arm 122, referred to as the shovel arm, includes an upper left arm 124, a lower left arm 126, and a shovel 128 in place of a hand. The shovel arm 122 is hingedly attached to the torso 116 to allow the shovel arm to rotate relative to the torso. In some implementations, the upper left arm 124, the lower left arm 126, and the shovel 128 define a single rigid structure. The upper left arm 124 is hingedly attached to the lower left arm 126 to allow the lower left arm to rotate relative to the upper left arm. In other implementations, the shovel 128 is hingedly attached to the lower left arm 126 to allow the shovel to rotate relative to the lower left arm. In yet other implementations, one or more pairs of components may be connected by ball-and-socket joints to permit a wider range of movement.

The toy 100 also includes a left handle 130 attached at the top of the torso 116. The left handle 130 is used to manipulate the shovel arm 122. The handle 130 is attached to the left arm 112 and movement of the handle 130 results in movement of the left arm 122 by rotating about a hinge 200.

Figure 3A:
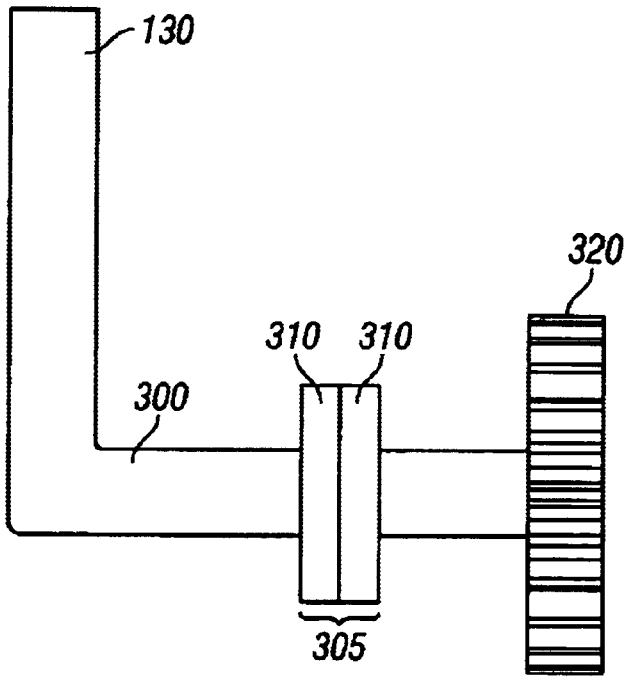
Figure 3B:
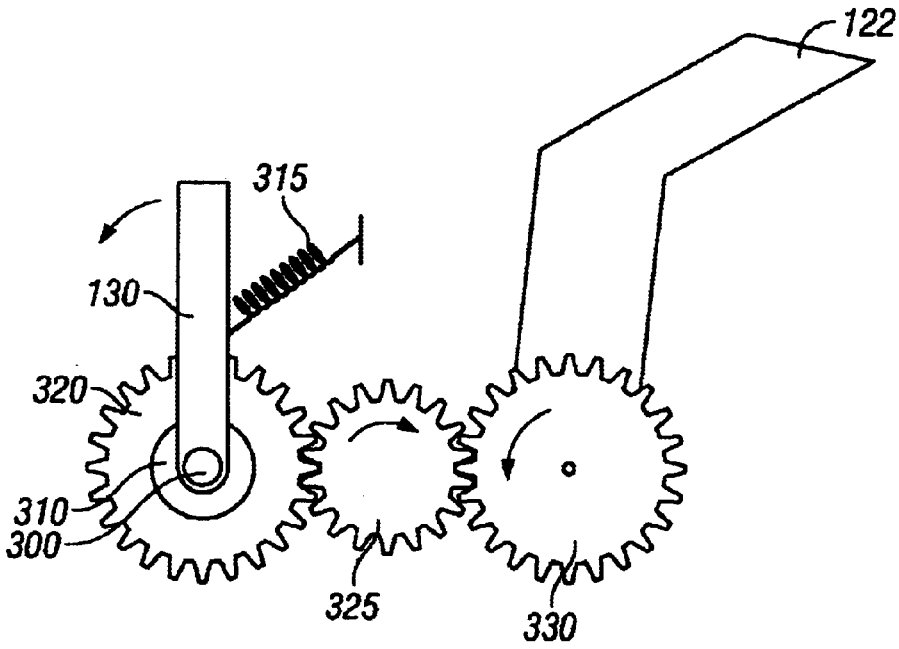

Referring also to FIGS. 3A and 3B, in another implementation, the left handle 130 rotates a shaft 300 having a friction clutch 305 that includes two lubricated flat disks 310 and restrains movement of the shovel arm 122 to prevent the operator of the shovel arm from throwing objects using the shovel 128. In particular, the disks 310 rotate together when the left handle is moved relatively slowly (i.e., at a rate that would not throw objects), and move relative to each other to allow slippage when the handle is moved quickly (i.e., at a rate that would throw objects). A spring 315 biases the left handle 130 in an upright position.

The shaft 300 includes a gear 320 that translates the rotation of the left handle 130 and the shaft into rotation of the shovel arm 122. In particular, rotation of the shaft 300 rotates the gear 320, which, in turn, rotates a gear 325 and a gear 330 connected to the shovel arm 122. This rotation of the shovel arm 122 allows the operator to dump materials into the cavity 113 of the bed 112 of the toy 100.

In other implementations, the handle 130 is attached directly to the left arm 112. With such an attachment, movement of the handle 130 directly results in movement of the left arm 122.

The right arm, referred to as the claw arm 132, includes an upper right arm 134, a lower right arm 136, and a claw fist 138. The claw arm 132 is hingedly attached to the torso 116 to allow the claw arm to rotate relative to the torso. The upper right arm 134 is hingedly attached to the lower right arm 136 to allow the lower right arm to rotate relative to the upper right arm 134. The claw fist 138 is hingedly attached to the lower right arm 136 to allow the claw fist to rotate relative to the lower arm. In other implementations, the upper right arm 134 and the lower right arm 136, the lower right arm 136 and the claw fist 138, or all three components, may define a single rigid structure. In yet other implementations, one or more pairs of components may be connected by ball-and-socket joints to permit a wider range of movement.

The toy 100 also includes a right handle 140 attached to the top of the claw arm 132. The right handle 140 is used to manipulate the claw arm 132. Like the left handle 130, a spring may bias the right handle 140 back to an upright position.

Figure 4A:
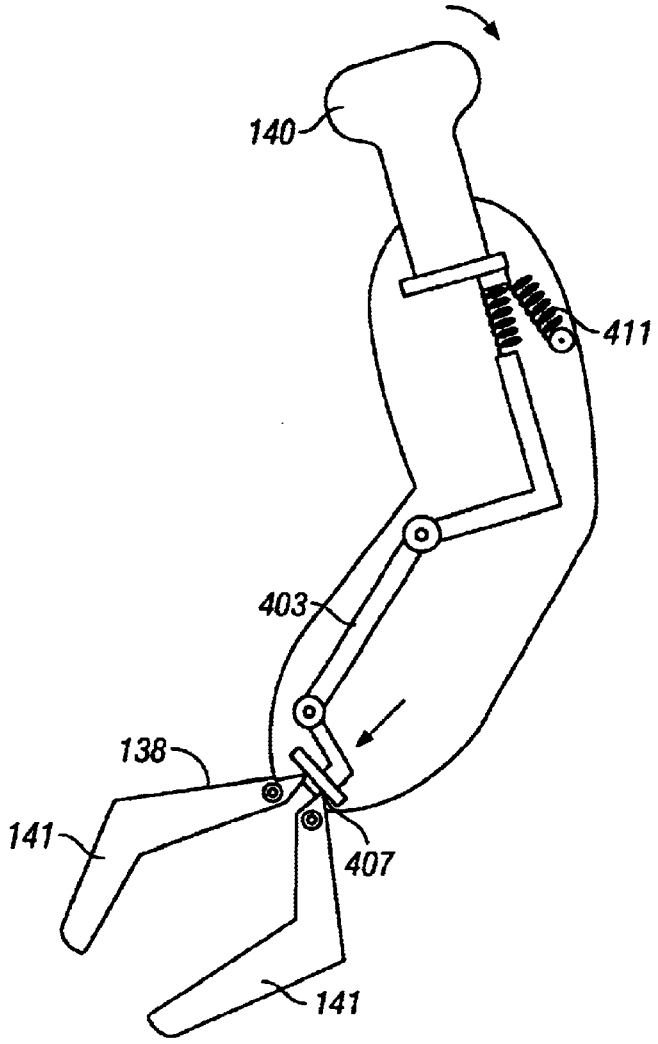
FIGS. 4A and 4B are schematic views of a system for operating a claw of the toy of FIGS. 1A–B.

The claw fist 138 includes movable claws 141 that may be made to open and close by movement of the right handle 140. Referring to FIG. 4A, movement of the right handle 140 in a downward direction extends a lever 403 springedly connected to the right handle that presses against tabs 407 on the base of the movable claws 141 causing them to open. A spring 411 biases the movable claw 141 to a closed position when the right handle 140 is released.

Figure 4B:
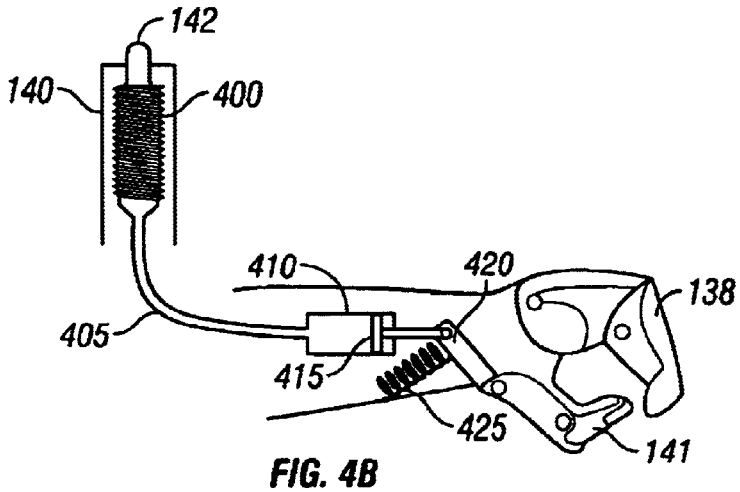

Referring to FIG. 4B, in another implementation, a button 142 presses on a bellows or bladder 400 that pushes air through a tube 405 to a cylinder 410. Air entering the cylinder 410 moves a plunger 415 that drives a lever 420 to open the claw 141. When the button is released, a spring 425 biases the claw 141 back to a closed position. In a further implementation, the right handle 140 rotates a shaft having a friction clutch and a gear train to move the claw fist 138.

Figure 5A:
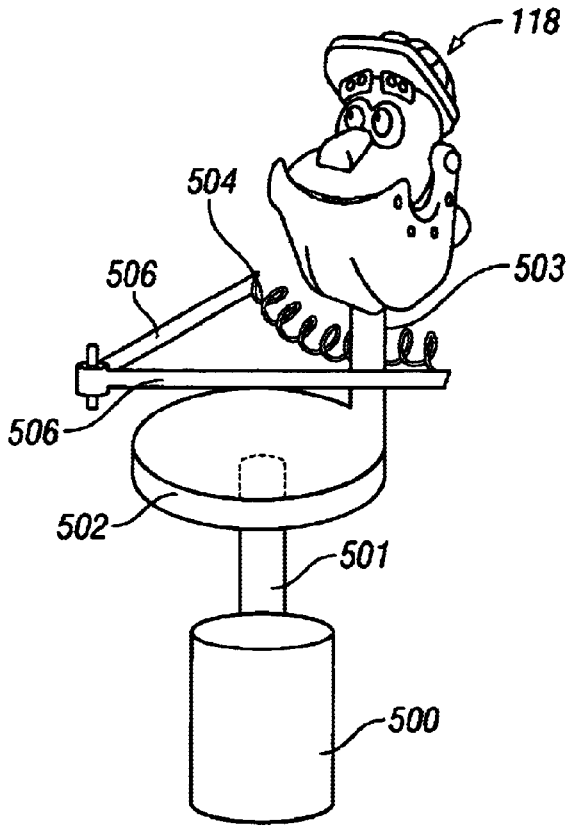
FIGS. 5A and 5B are schematic views of a system for moving a head of the toy of FIGS. 1A–B.

Referring to FIG. 5A, the head 118 is connected to the torso 116 in a manner that allows the head to rotate relative to the torso. A motor 500 with a shaft 501 connects to a circular disk 502. A rod 503 connects to the perimeter of the disk to the head 118. The motor 500 rotates the head 118 and the spring 504 connected to pivot bars 506 returns the head 118 to a forward position. The head 118 may have an animated appearance giving the toy 100 the appearance of a dinosaur or robot. The head 118 also includes a jaw 160 that is hinged to move up and down relative to the head.

Figure 5B:
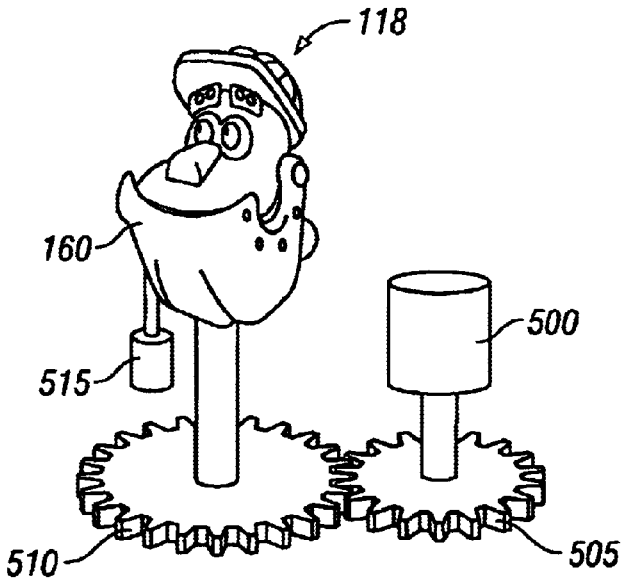

In another implementation, as shown FIG. 5B, a motor 500 with a pinion 505 and a spur gear 510 are connected to rotate the head. The motor has a clutch (not shown) that allows the head 118 to be rotated 360 degrees without breaking the toy 100. In this implementation, the movement of the jaw is controlled by a solenoid 515.

The handles 130, 140 may be used to steer the toy 100. In particular, pushing one handle forward and pulling the other handle back causes the front wheels 110 to turn relative to the chassis 106 in the direction of the handle that is pulled back.

Figure 6:
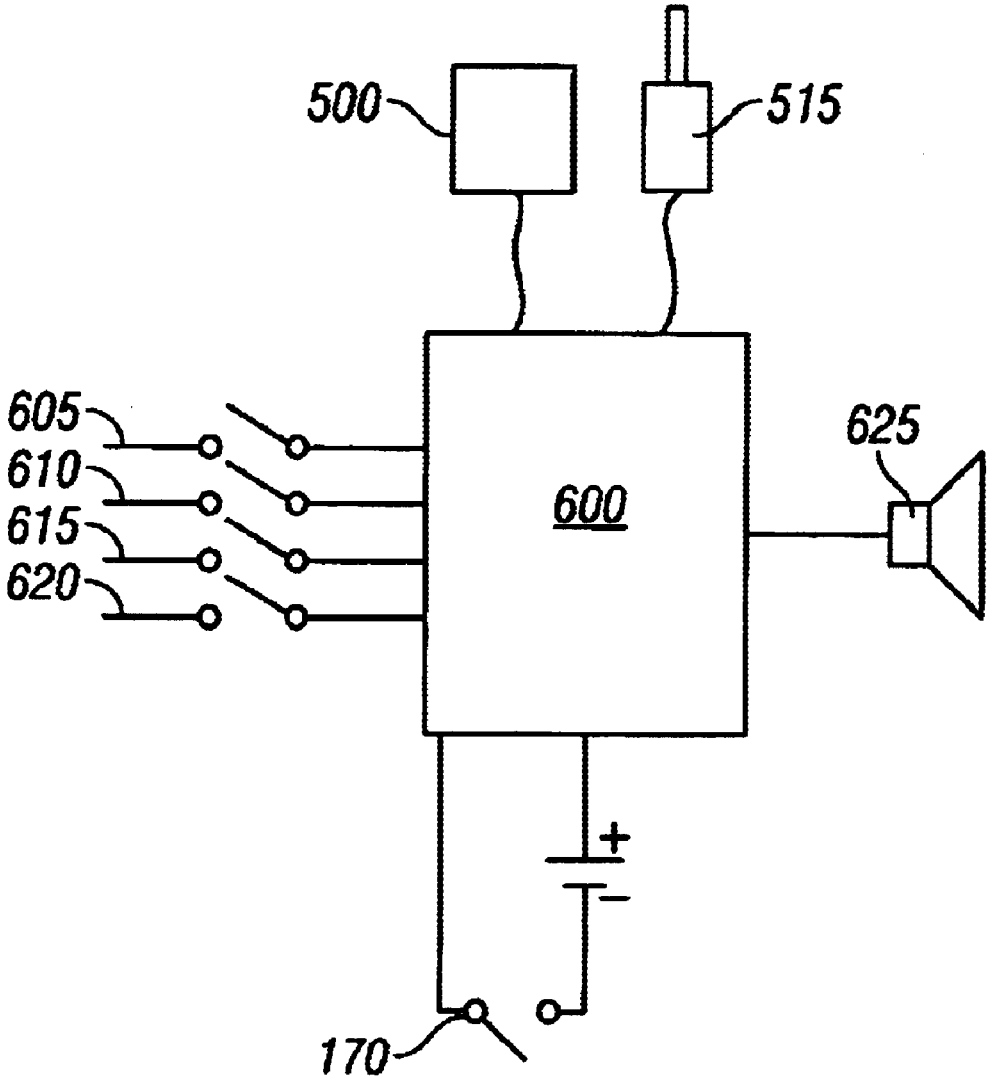
FIG. 6 is a block diagram of a processor and related components of the toy of FIGS. 1A–B.

Referring also to FIG. 6, the toy 100 contains a processor 600 that is configured to provide the toy with speech and automatic movements. The processor 600 is connected to switches 605, 610 that are actuated by movement of, respectively, the claw arm 132 and the shovel arm 122. The processor 600 is also connected to a switch 615 that is actuated by movement of the bed 112 and a switch 620 that is actuated by movement of the wheels 108, 110. Finally, the processor 600 is connected to the motor 500, to the solenoid 515, and to a speaker 625 located in the toy. The processor 600 is activated by an on/off switch 170 located on the lower body 104.

When one of the switches is actuated by movement of a corresponding part of the toy 100, the processor 600 responds by producing a signal that causes the speaker 625 to produce speech or other sounds. At the same time, the processor 600 sends signals to the motor 500 and the solenoid 515 to cause the head to turn and the jaw 160 to move up and down in a way that simulates speech.

The processor may produce different sounds and speech in response to actuation of different switches and different combinations of switches. In addition, if a particular switch is actuated multiple times, the processor 600 may produce different sounds and speech in response to each actuation.

When the toy 100 is not manipulated within a predetermined time period (e.g., if a switch is not actuated within 30 seconds), the processor enters a "bored" mode. In the bored mode, the processor causes the speaker to ask questions. Once in the bored mode, if the toy is not manipulated within a second predetermined time period (e.g., if a switch is not actuated within 30 seconds), the processor causes the speaker to start speaking again. If the toy is not manipulated within a third predetermined time period following the second predetermined time period (e.g., if a switch is not actuated within an additional 60 seconds), the processor causes the speaker to make snoring noises and the processor then enters a sleep mode in which the processor turns off. Once the processor is in sleep mode, the on/off switch 170 must be actuated to turn on the processor.

Figure 7:
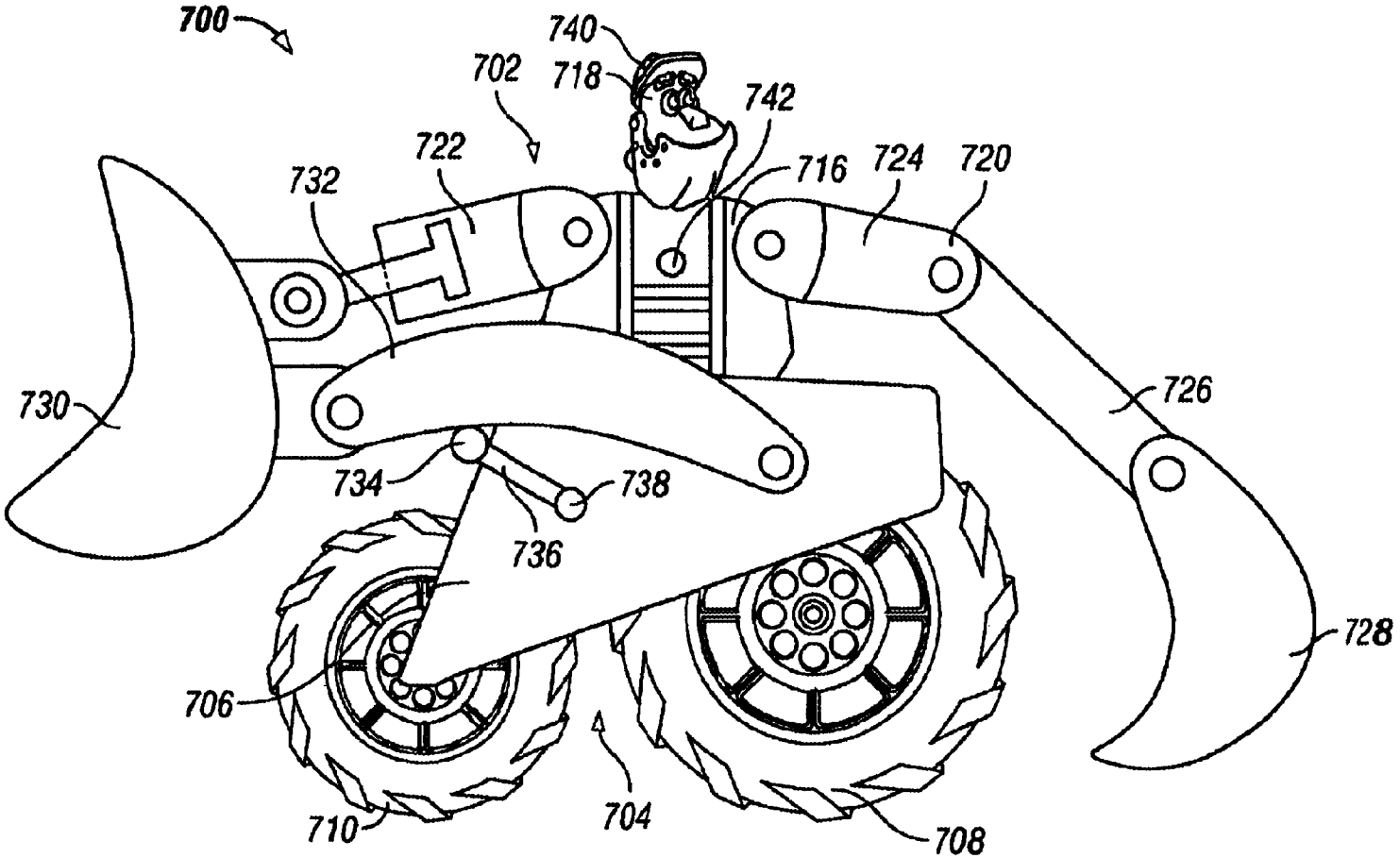
FIG. 7 is a side view of a toy.

Referring to FIG. 7, a toy 700 is configured and operates similarly to the toy 100 of FIGS. 1A and 1B. The toy 700 includes an upper body 702 having character features and a lower body 704 having vehicular features and connected to the upper body 702. The lower body 704 includes a chassis 706. The toy 700 includes a freely rotatable rear wheel 708 and a freely rotatable front wheel 710 attached to the chassis 706 on each side of the toy 700. The front wheels 710 have smaller diameters than the rear wheels 708.

The upper body 702 of the toy 700 includes a torso 716 connected to the chassis 706 and a head 718 connected to the torso, such that the upper body has the features of a character. Two arms 720, 722 are also connected to the torso 716.

The left arm 720 is in the form of a backhoe, and is connected to the torso 716 by a joint that permits the arm to rotate relative to the torso. The left arm 720 includes an upper section 724, a lower section 726, and a scoop 728, all of which are hingedly connected to each other. In other implementations, the upper section and the lower section, the lower section and the scoop, or all three components, form a single rigid structure. In yet other implementations, one or more pairs of the components are connected by ball-and-socket joints to permit increased movement.

Unlike the toy 100, the toy 700 does not include a handle for use in manipulating the arm 720. Instead, a user manipulates the arm by grasping the arm.

The toy 700 also includes a front loader 730 that is connected to the toy by the arm 722, which extends between the front loader and the torso 716, and by a support member 732, which extends between the front loader and the chassis 706. In other embodiments, the toy 700 has a support member 732 on each side that extend between the front loader 730 and the chassis 706.

A handle 734, which is connected to a shaft 736 that rotates about an axis 738, is used to raise and lower the front loader 730. Rotating the handle about the axis in a clockwise direction causes the handle to push against the support member 732 and lift the front loader 730. Rotating the handle about the axis in a counter-clockwise direction permits the front loader 730 to go back down. A second handle may be provided on the opposite side of the front loader 730 to permit a load to be dumped from the front loader 730 (i.e., to permit rotation of the front loader relative to the arm and the support member).

A spring-loaded hat 740 is located on top of the head 718 of the toy 700. Pressing a button 742 on the torso 716 causes the hat 740 to pop up, and causes the toy to generate a whistling sound.

Figure 8:
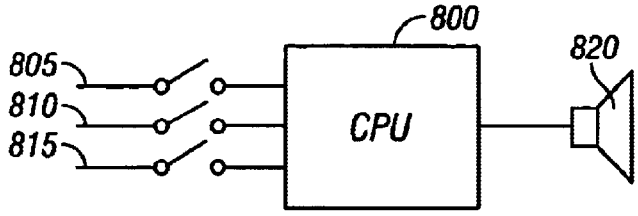
FIG. 8 is a block diagram of a processor and related components of the toy of FIG. 7.

Referring to FIG. 8, the toy 700, like the toy 100, contains a processor 800 that is configured to make the toy generate speech and sounds. The processor 800 is connected to switches 805, 810 and 815 that are actuated by movement of, respectively, the front loader 730, the backhoe arm 720, and the button 742. The processor 800 also is connected to a speaker 820 located in the toy.

The processor 800 responds to actuation of the switch 815 by producing a signal that causes the speaker to produce the whistling sound noted above. The processor 800 responds to actuation of the other switches by causing the speaker to generate other sounds. For example, in one implementation, the first time that the switch 805 is actuated, the processor 800 causes the speaker to say "Trenches, ditches, you name it, we can dig it." The second time that the switch 805 is actuated; the processor 800 causes the speaker to say, "Ho, we can dig over here, we can dig back there." The third time that the switch 805 is actuated, the processor 800 causes the speaker to say "Scooping, digging, this is great." The fourth time that the switch 805 is actuated; the processor 800 causes the speaker to say "Dig, dig, dig." The fifth time that the switch 805 is actuated, the processor 800 causes the speaker to say "Hey, let's dig some over there." Thereafter, actuations of the switch 805 cause the speaker to cycle between "Dig, dig, dig," "Hot diggity dig" and "This is great. Similarly, actuation of the switch 810 causes the speaker to cycle through the same phrases. In other implementations, actuation of the switch 805 causes the speaker to say "Let's get dozin',", "Let's push some dirt," "Wrecking ball coming through," "I love to play wreckin' ball," and "Knocking down." In another implementation, actuation of the switch 805 causes the speaker to say "Hoo hoo, let's get to work," "Let's push some dirt" and "Rrrrrg, this is heavy."

If no switch 805 is actuated within 25 seconds, the speaker says, "let's dig some over there," and then the processor 800 turns off. In another implementation, if the toy is left alone for 25 seconds it responds, "Oh, I was dozin' off" "Hoo hoo, let's get to work," and then shuts off.

Figure 9:
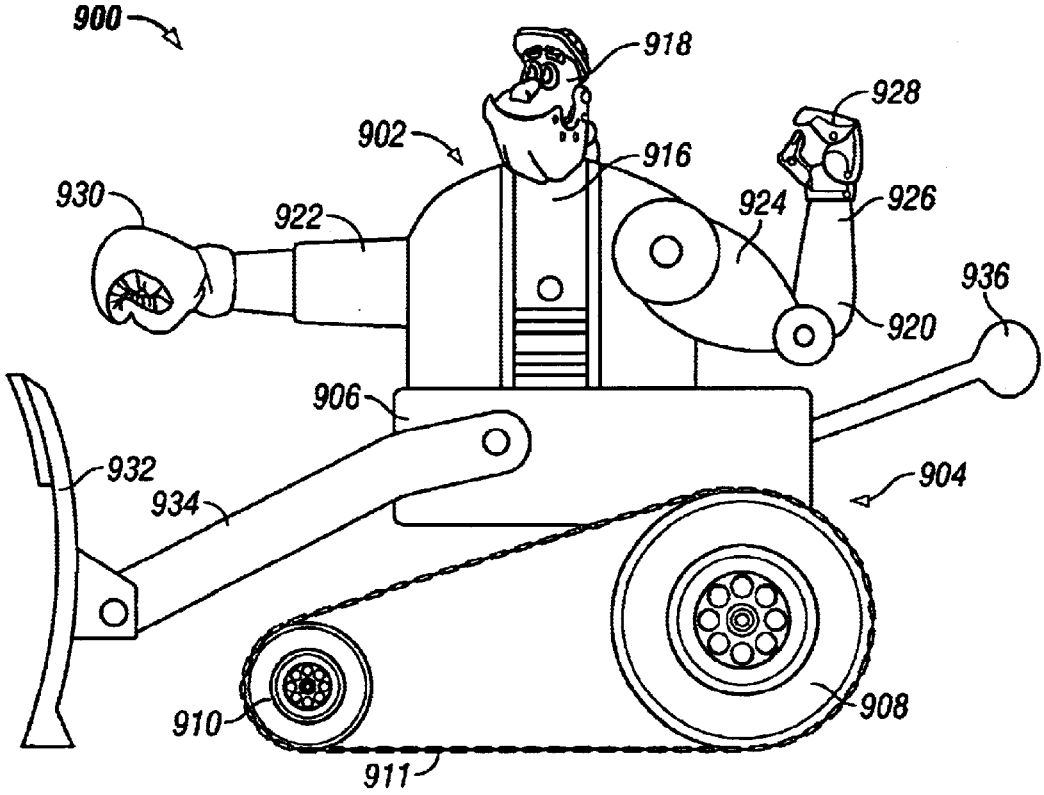
FIG. 9 is a side view of a toy.

Referring to FIG. 9, a toy 900 is configured and operates similarly to the toy 100 of FIGS. 1A and 1B. The toy 900 includes an upper body 902 having character features and a lower body 904 having vehicular features and connected to the upper body 902. The lower body 904 includes a chassis 906. The toy 900 includes a freely rotatable rear wheel 908 and a freely rotatable front wheel 910 attached to the chassis 906 on each side of the toy 900 and encircled by a track 911. The front wheels 910 have smaller diameters than the rear wheels 908.

The upper body 902 of the toy 900 includes a torso 916 connected to the chassis 906 and a head 918 connected to the torso, such that the upper body has the features of a character. The torso sits on the chassis 906 and is rotatable relative to the chassis. Two arms 920, 922 are also connected to the torso 916.

The left arm 920 is connected to the torso by a joint that permits the arm to rotate relative to the torso. The left arm 920 includes an upper section 924, a lower section 926, and an oversized hand 928, all of which are rigidly connected to each other. In other implementations, the upper section and the lower section, the lower section and the scoop, or all three components, are connected by hinges or ball-and-socket joints. The arm 920 is manipulated by a user grasping the arm.

The right arm 922 includes a spring-loaded fist 930 that may be launched by moving the left arm 920.

The toy 900 also includes a dozer blade 932 that is coupled to the chassis by support members 934. The dozer blade 932 is raised and lowered by raising and lowering a lever 936 that extends from the back of the chassis.

Figure 10:
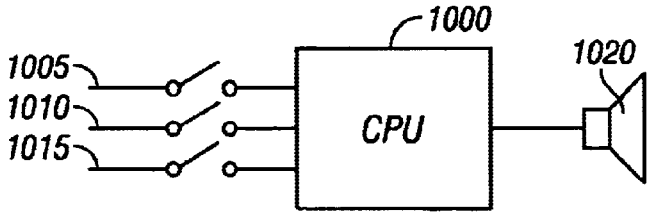
FIG. 10 is a block diagram of a processor and related components of the toy of FIG. 9.

Referring to FIG. 10, the toy 900, like the toy 100, contains a processor 1000 that is configured to make the toy generate speech and sounds. The processor 1000 is connected to switches 1005, 1010 and 1015 that are actuated by movement of, respectively, the lever 936, the left arm 920, and the torso 906. The processor 1000 also is connected to a speaker 1020 located in the toy.

The processor responds to actuation of the switches by causing the speaker to produce appropriate sounds. For example, the first time that a switch 1005 is actuated, the speaker says "Hoo hoo, let's get to work." When the switch 1005 is actuated again, the speaker says "Let's push some dirt," "Time to get the pistons firing," and "Oh yeah, let's get dozing." Subsequent actuations result in grunt sounds.

If no switch is actuated for 25 seconds, toy responds "Oh, I was dozin' off," or "Hoo hoo, let's get to work," and then the processor turns off.

Other implementations are within the scope of the following claims.

What is claimed is:

1. A combination action figure/toy construction vehicle comprising:

an action figure portion including a torso, a head attached to the torso, and at least one arm attached to the torso, the action figure portion lacking leg and feet components; and a toy construction vehicle portion including a chassis, a construction tool attached to the chassis, and at least one wheel attached to the chassis, the toy construction vehicle portion lacking a cab;

wherein the action figure portion is attached to the chassis in place of the cab for the toy construction vehicle portion; and Wherein the toy construction vehicle portion supports the action figure portion.

2. The combination action figure/toy construction vehicle as in claim 1 wherein the at least one arm comprises two arms attached to different sides of the torso.

3. The combination action figure/toy construction vehicle as in claim 2 further comprising a fist connected to a first of the two arms.

4. The combination action figure/toy construction vehicle as in claim 3 wherein the fist is propelled away the first of the two arms when a release mechanism is actuated.

5. The combination action figure/toy construction vehicle as in claim 4 wherein the fist is connected to the first of the two arms such that the fist is positioned parallel to the ground.

6. The combination action figure/toy construction vehicle as in claim 3 wherein the fist is capable of being rotated relative to an axis that is perpendicular to the torso.

7. The combination action figure/toy construction vehicle as in claim 3 further comprising a shovel connected to a second of the two arms in place of a hand.

8. The combination action figure/toy construction vehicle as in claim 7 wherein the fist is a movable claw.

9. The combination action figure/toy construction vehicle as in claim 1 wherein the at least one arm resembles a backhoe.

10. The combination action figure/toy construction vehicle as in claim 1 wherein the action figure portion is capable of being rotated relative to the toy construction vehicle portion.

11. The combination action figure/toy construction vehicle as in claim 1 wherein the at least one wheel comprises front and rear wheels with a track extending around the front and rear wheels.

12. The combination action figure/toy construction vehicle as in claim 1 wherein the construction tool comprises a loader bucket attached to the chassis by a support member.

13. The action figure as in claim 12 wherein the toy construction vehicle portion further comprises a hinge connecting the support member to the loader bucket and enabling movement of the loader bucket relative to the chassis.

14. The action figure as in claim 12 wherein the toy construction vehicle portion further comprises a lever connected to the loader bucket allowing movement of the loader bucket relative to the chassis.

15. The combination action figure/toy construction vehicle as in claim 1 wherein the action figure further comprises a sound generation system.

16. The combination action figure/toy construction vehicle as in claim 15 wherein the sound generation system further comprises a sound activating switch and the sound generation system generates a sound based upon an actuation of the switch.

17. The combination action figure/toy construction vehicle as in claim 16 wherein the construction tool comprises a loader bucket attached to the chassis by a support member and the sound activating switch is activated upon a change in position of the loader bucket.

18. The combination action figure/toy construction vehicle as in claim 16 wherein the sound activation switch is actuated based upon a change in position of the at least one arm.

19. The combination action figure/toy construction vehicle as in claim 15 wherein the sound-activating switch further comprises a button on the torso such that the sound activating switch is actuated by actuation of the button.

20. The combination action figure/toy construction vehicle as in claim 1 wherein the construction tool comprises a bed defining a cavity.

21. The combination action figure/toy construction vehicle as in claim 20 wherein the bed is hingedly attached to the chassis.

22. The combination action figure/toy construction vehicle as in claim 1 wherein the construction tool comprises a dozer blade.

23. The combination action figure/toy construction vehicle as in claim 1 further comprising a shovel connected to the at least one arm in place of a hand.

* * * * *